US007793890B2

(12) United States Patent
Scherer

(10) Patent No.: US 7,793,890 B2
(45) Date of Patent: Sep. 14, 2010

(54) CONTROL SYSTEM FOR AN AIRCRAFT

(75) Inventor: Patrick L. Scherer, 68400 Powell Rd., Washington, MI (US) 48095

(73) Assignee: Patrick L. Scherer, Naples, FL (US)

( * ) Notice: Subject to any disclaimer, the term of this patent is extended or adjusted under 35 U.S.C. 154(b) by 780 days.

(21) Appl. No.: 11/739,403

(22) Filed: Apr. 24, 2007

(65) Prior Publication Data

US 2008/0180272 A1 Jul. 31, 2008

Related U.S. Application Data

(60) Provisional application No. 60/887,403, filed on Jan. 31, 2007.

(51) Int. Cl.
*B64C 13/20* (2006.01)
*A63F 9/24* (2006.01)

(52) U.S. Cl. ..... 244/190; 244/189; 463/39

(58) Field of Classification Search ..... 244/189, 244/190, 220–222, 228, 234, 236; 341/176, 341/22; 463/39; 343/705; 414/4; 345/156, 345/158

See application file for complete search history.

(56) References Cited

U.S. PATENT DOCUMENTS

| | | | | |
|---|---|---|---|---|
| 3,580,636 | A * | 5/1971 | Setto | 297/411.32 |
| 4,464,116 | A | 8/1984 | Schoolcraft | |
| 4,574,651 | A | 3/1986 | Nordström | |
| 4,584,510 | A | 4/1986 | Hollow | |
| 4,954,820 | A | 9/1990 | Kohno et al. | |
| 5,038,144 | A | 8/1991 | Kaye | |
| 5,129,826 | A | 7/1992 | Munsch | |
| D342,297 | S | 12/1993 | Kouno | |
| 5,379,663 | A * | 1/1995 | Hara | 74/471 XY |
| 5,503,040 | A * | 4/1996 | Wright | 74/471 XY |
| 5,735,490 | A | 4/1998 | Berthet et al. | |
| 5,764,164 | A | 6/1998 | Cartabiano et al. | |
| 5,878,981 | A | 3/1999 | Dewey | |
| 6,184,804 | B1 * | 2/2001 | Harrison | 341/22 |
| 6,264,146 | B1 | 7/2001 | Hill et al. | |
| 6,315,667 | B1 * | 11/2001 | Steinhart | 463/39 |
| D471,603 | S | 3/2003 | Morita et al. | |
| 6,572,482 | B1 | 6/2003 | Lewis, Jr. | |
| 6,754,069 | B2 * | 6/2004 | Harada | 361/679.03 |
| 6,906,700 | B1 | 6/2005 | Armstrong | |
| 6,909,420 | B1 * | 6/2005 | Nicolas et al. | 345/156 |
| 7,010,628 | B2 | 3/2006 | Cloud et al. | |
| 7,410,338 | B2 * | 8/2008 | Schiele et al. | 414/4 |
| 2004/0082269 | A1 | 4/2004 | Wright | |
| 2005/0236525 | A1 | 10/2005 | Marjanski | |
| 2008/0208396 | A1 * | 8/2008 | Cairola et al. | 701/3 |

FOREIGN PATENT DOCUMENTS

| | | | | |
|---|---|---|---|---|
| JP | 299998 | * | 12/1990 | 244/190 |
| WO | 2004/096639 | A2 | 11/2004 | |
| WO | 2004/096639 | A3 | 11/2004 | |

* cited by examiner

*Primary Examiner*—Tien Dinh

(57) ABSTRACT

A control system for an aircraft includes a main unit and a separate auxiliary unit in communication with the main unit. The main unit includes an arm support allowing attachment to an arm of an operator. The main unit also includes a control stick supported by the structural element and movable in a plurality of directions. The main unit further includes sensors for sensing movement of the control stick. The auxiliary unit includes a transmitter for sending a transmitter signal encoding the movement of the control stick to the aircraft.

17 Claims, 9 Drawing Sheets

CONTROL SYSTEM FOR AN AIRCRAFT

CROSS REFERENCE TO RELATED APPLICATION

This application claims the benefit of U.S. Provisional Patent Application Ser. No. 60/887,403 filed Jan. 31, 2007.

BACKGROUND OF THE INVENTION

1. Field of the Invention

The subject invention relates to a system to control an aircraft, such as a radio-controlled (RC) aircraft.

2. Description of the Related Art

Flying RC aircraft is a popular and growing hobby enjoyed by a wide variety of people. RC aircraft are also used by scientific and government organizations in scientific experiments, such as gathering meteorological information, and military applications, such as drones or spy planes. Flying RC aircraft commonly requires a large, obstruction free area to allow take-offs, landings, and flight of the aircraft.

Typically, most hobbyists control their RC aircraft using a remote control unit. Such units are available from a variety of manufacturers. One example of such a unit may be appreciated from U.S. Design Pat. No. D342,297 to Kouno (the '297 patent). The unit shown in the '297 patent includes a number of features that are typically found on most remote control units including a pair of joysticks which provide the primary control of the aircraft. Each joystick is movable in two main directions, thus providing four directions of movement. These four directions of movement typically provide control over elevators, ailerons, throttle, and a rudder of the aircraft. The unit also includes a battery, a transmitter, and an antenna.

The prior art remote control units shown, however, have several drawbacks. First, the weight of the battery and transmitter may tend to make the unit very heavy and difficult to hold for long periods of time. As a result, most RC aircraft hobbyists connect a strap to the unit and support the strap using their neck. As a result, neck fatigue often occurs when operating for more than a short-period of time. Furthermore, the joysticks of the unit are positioned relatively close together. This results in an unnatural and uncomfortable operating arrangement for the operator of the RC aircraft. Moreover, this operating arrangement bears little resemblance to the controls of a cockpit-flown aircraft.

One attempt at addressing some of the above mentioned deficiencies can be seen in U.S. Pat. No. 5,038,144 to Kaye (the '144 patent). The '144 patent discloses an arm-mountable control unit having a control stick movable in a plurality of directions for controlling elevators and ailerons of the aircraft. A throttle button is provided to allow control over the throttle. The unit also includes a battery, transmitter, and antenna which are also supportable by an arm of the user. The weight of these components undoubtedly causes arm strain and an uncomfortable operating arrangement.

There remains an opportunity to provide a control system for an RC aircraft that provides minimal fatigue and strain to the user. Furthermore, there also remains an opportunity to provide a control system that more accurately simulates operation of a cockpit-controlled aircraft. Also, there remains an opportunity to provide a control system that allows for operation of the RC aircraft in a more confined area.

SUMMARY OF THE INVENTION AND ADVANTAGES

The subject invention provides a control system for an aircraft. The system includes a main unit having a structural element having an arm support for attachment to an arm of an operator. The main unit also includes a control stick supported by the structural element and movable in a plurality of directions. The main unit further includes at least one control stick sensor operatively connected to the control stick for sensing movement of the control stick and generating a control stick sensor signal corresponding to the movement of the control stick. The system also includes an auxiliary unit separate from the main unit. The auxiliary unit includes a transmitter in communication with the at least one sensor for sending a transmitter signal to the aircraft corresponding to the control stick sensor signal for controlling the aircraft.

By disposing the transmitter in the auxiliary unit separate from the main unit, the arm of the operator need not support this weight. Therefore, fatigue and strain to the arm are kept to a minimum, allowing a more comfortable experience which may be sustained for a longer period of time.

The control system of the subject invention may also provide a guide piece supported by the structural element and defining an elongated slot. The control stick includes an upper end and a lower end. A pin is disposed in the control stick between the upper and lower ends and defines a first pivot axis. The pin is also slidably disposed in the elongated slot such that the control stick pivots about the pivot axis and simultaneously slides along the elongated slot within a vertical plane. The interface between the control stick and the elongated slot allows for easy movement of the control stick in the vertical plane with a simple, slight movement of the wrist.

The control system of the subject invention may also provide an attachment apparatus supported by the structural element for allowing attachment of a line connecting the structural element to the aircraft. This allows the tethered, line-control of the RC aircraft. The line-controlled aircraft can then be operated in a much smaller obstruction-free area.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
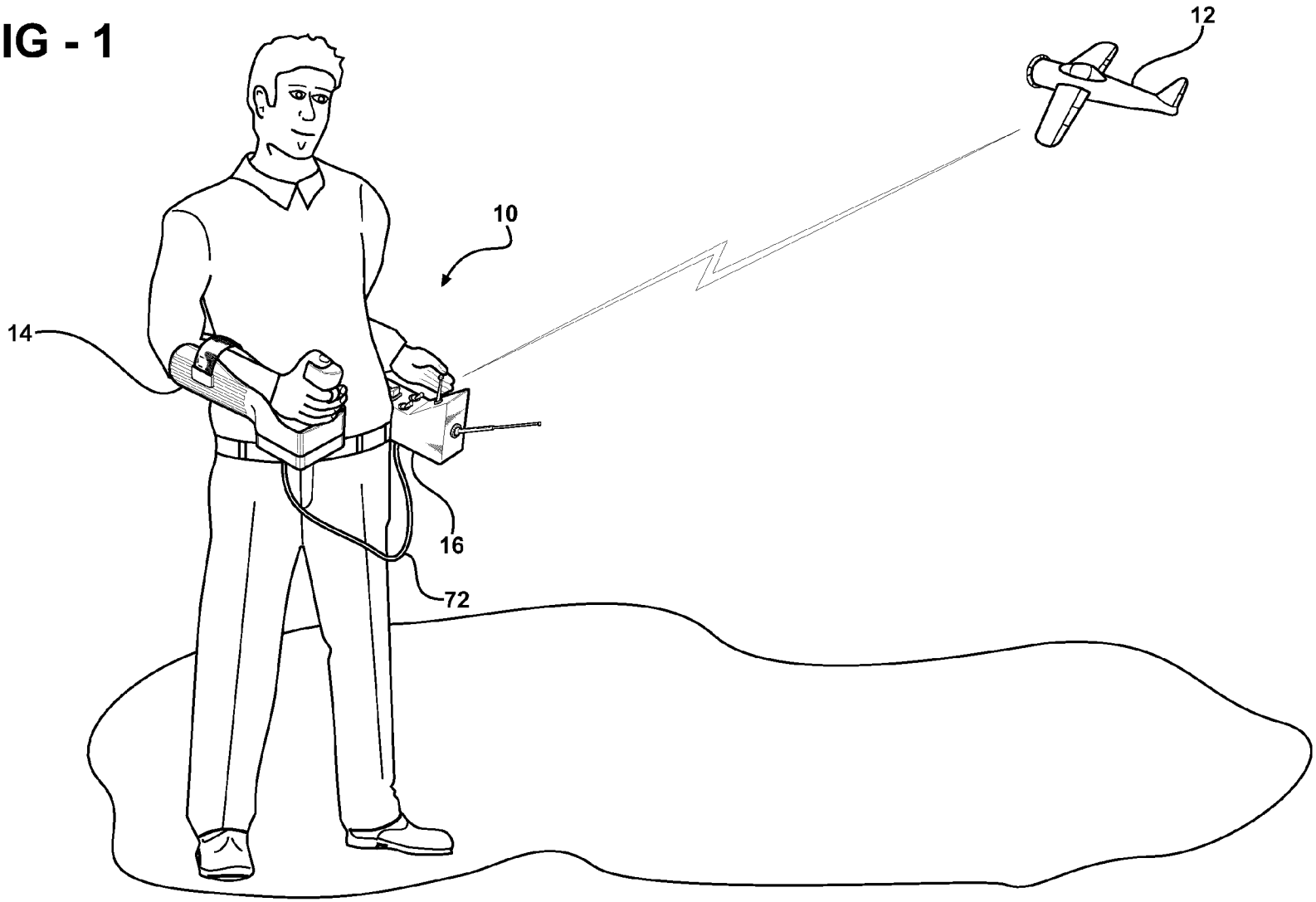
FIG. 1 is a perspective view of a control system for controlling an aircraft.

Referring to the Figures, wherein like numerals indicate corresponding parts throughout the several views, a control system 10 for an aircraft 12 is shown in FIG. 1. The aircraft 12 may be a scale model aircraft 12, such as those operated by hobbyists. However, the control system 10 described herein may be used to control other aircraft 12, such as drone aircraft 12. Furthermore, although FIG. 1 illustrates a fixed wing aircraft 12, those skilled in the art realize that the control system 10 may be used to control rotorcraft, such as helicopters. Moreover, the control system 10 described herein may be used to control other vehicles besides aircraft 12, such as, but not limited to, watercraft, land vehicles (race cars, tanks, etc.), or other remotely controllable objects.

The control system 10 includes a main unit 14 and an auxiliary unit 16. In a preferred embodiment, the units 14, 16 are physically separate from one another. Although physically separate, the units 14, 16 are in communication with each other, as described in detail below. However, in alternative embodiments, the main and auxiliary units 14, 16 may be integrated into a single device.

Figure 2:
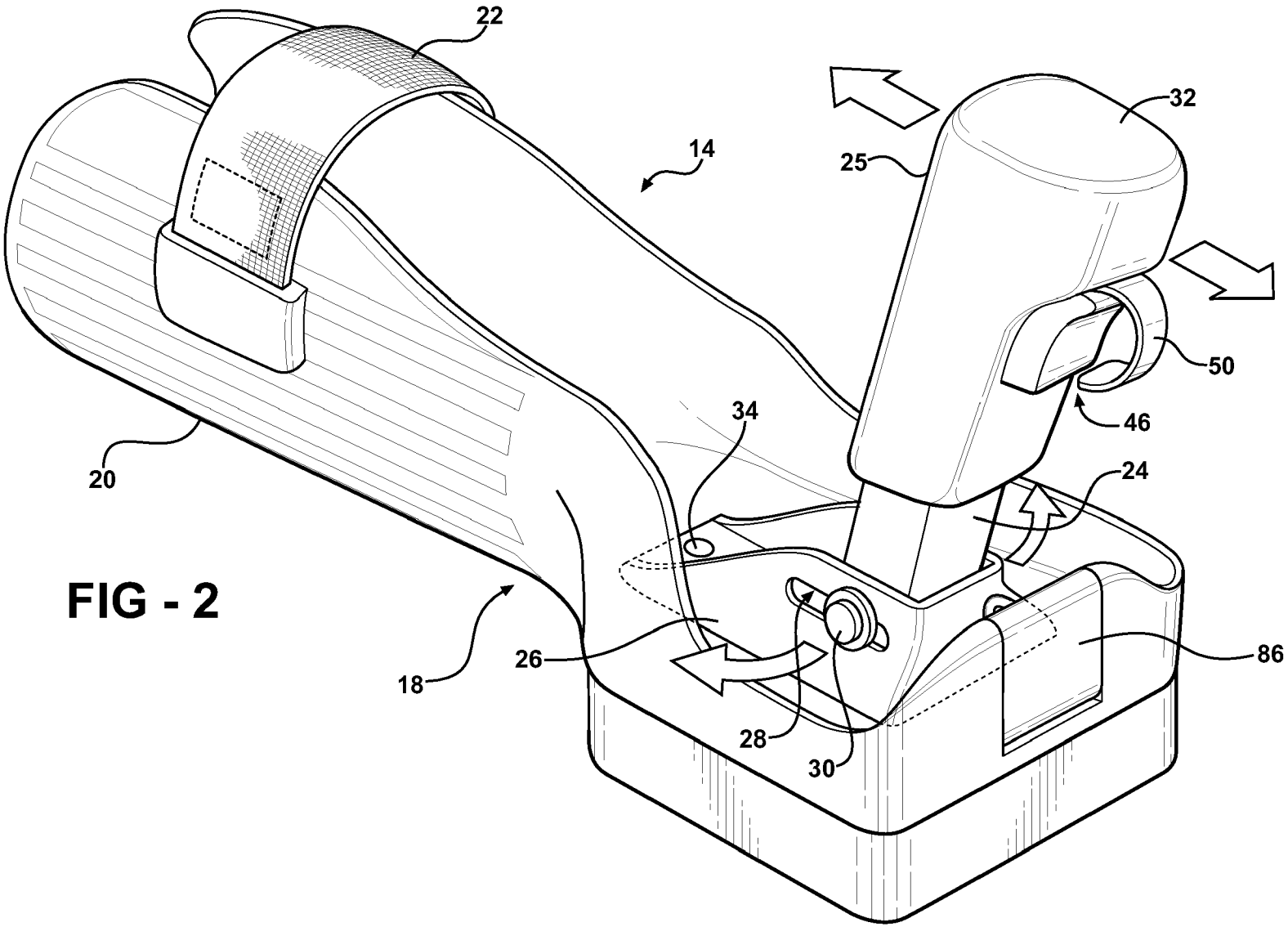
FIG. 2 is a perspective view of a main unit of the control system.

Referring now to FIG. 2, the main unit 14 includes a structural element 18. The structural element 18 includes an arm support 20 allowing attachment to an arm of an operator. The arm support 20 is preferably formed of plastic and may include padding (not shown). The arm support 20 also includes at least one strap 22 for securing the main unit 14 to the arm of the user. The strap 22 may include hook and loop fasteners (not shown) or another type of fastener to secure the main unit 14 to the arm of the user. The main unit 14 may be supported on either hand of the user for right-handed or left-handed operation.

The main unit 14 includes a control stick 24 supported by the structural element 18. In the preferred embodiment, a guide piece 26 is supported by the structural element 18 and the guide piece 26, in turn, supports the control stick 24. The control stick 24 includes an upper end 25 and a lower end 27. The upper end of the control stick 24 preferably accommodates a handle 32. The handle 32 is contoured to allow convenient gripping by the user.

The control stick 24 is operatively connected to the guide piece 26 to allow movement of the control stick 24 in a plurality of directions. Specifically, the control stick 24 is movable in a vertical plane such that the control stick 24 may be pushed away or pulled toward the user. More specifically, the guide piece 26 of the preferred embodiment defines a slot 28 which is elongated. A pin 30 is disposed in the control stick 24 between the upper and lower ends and defines a pivot axis. The pin 30 is preferably disposed approximate the lower end of the control stick 24.

Figure 3:
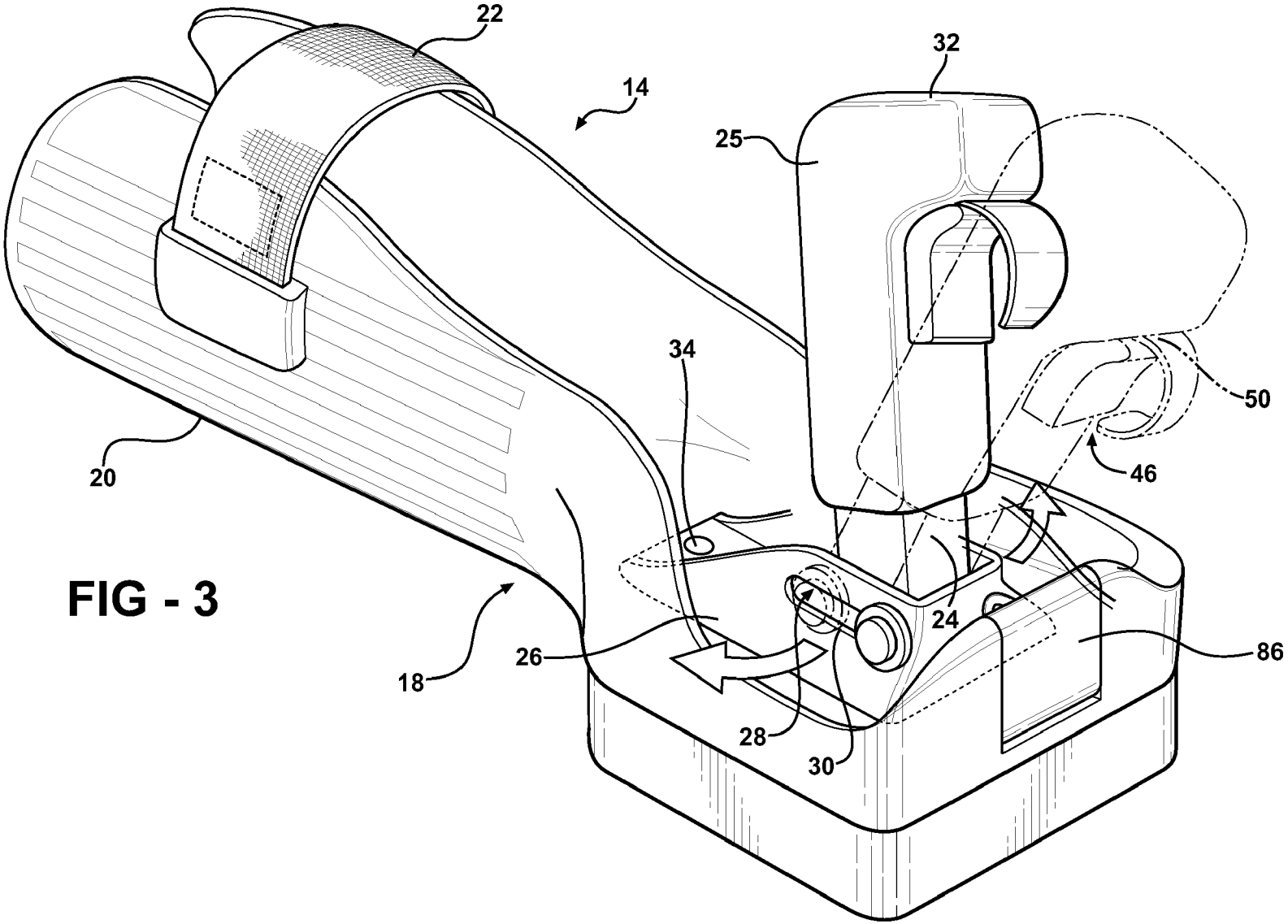
FIG. 3 is a perspective view of the main unit showing movement of a control stick.

The pin 30 is slidably disposed in the elongated slot 28 such that the control stick 24 pivots about the pivot axis and simultaneously slides along the elongated slot within the vertical plane. This configuration allows the user to move the control stick 24, as is shown in FIG. 3, in the vertical plane simply by pivoting their hand at the wrist. This requires minimal hand motion and prevents over extension of the hand and wrist while still allowing the user to move the control stick 24 through its full range of motion in the vertical plane. The pin 30 may be implemented as a bolt and nut to secure the control stick 24 to the guide piece 24. Of course, those skilled in the art realize other techniques to allow the pin 30 to slide in the slot 28. Furthermore, in alternative embodiments (not shown), the slot 28 may not be elongated, such that the lower end of the control stick 24 does not slide along the slot 28.

Figure 4A:
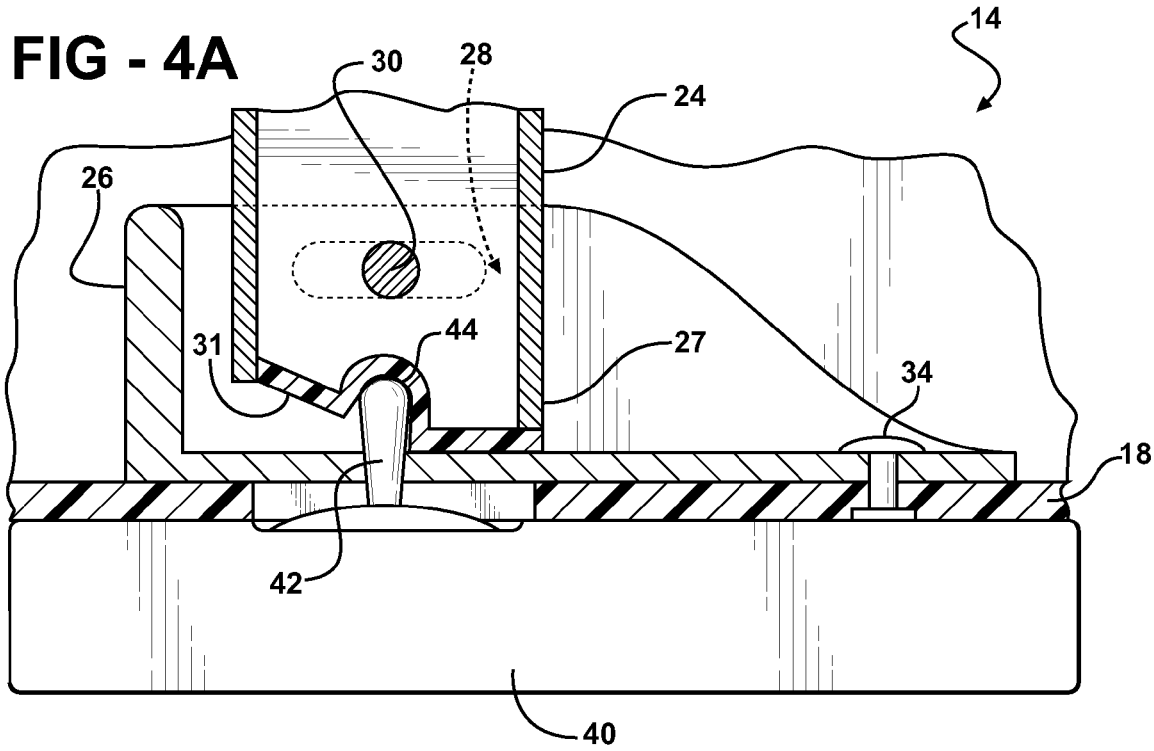
FIG. 4A is a partial cross-sectional view of the main unit showing a sensor block operatively connected to the control stick while the control stick is in one position.
Figure 4B:
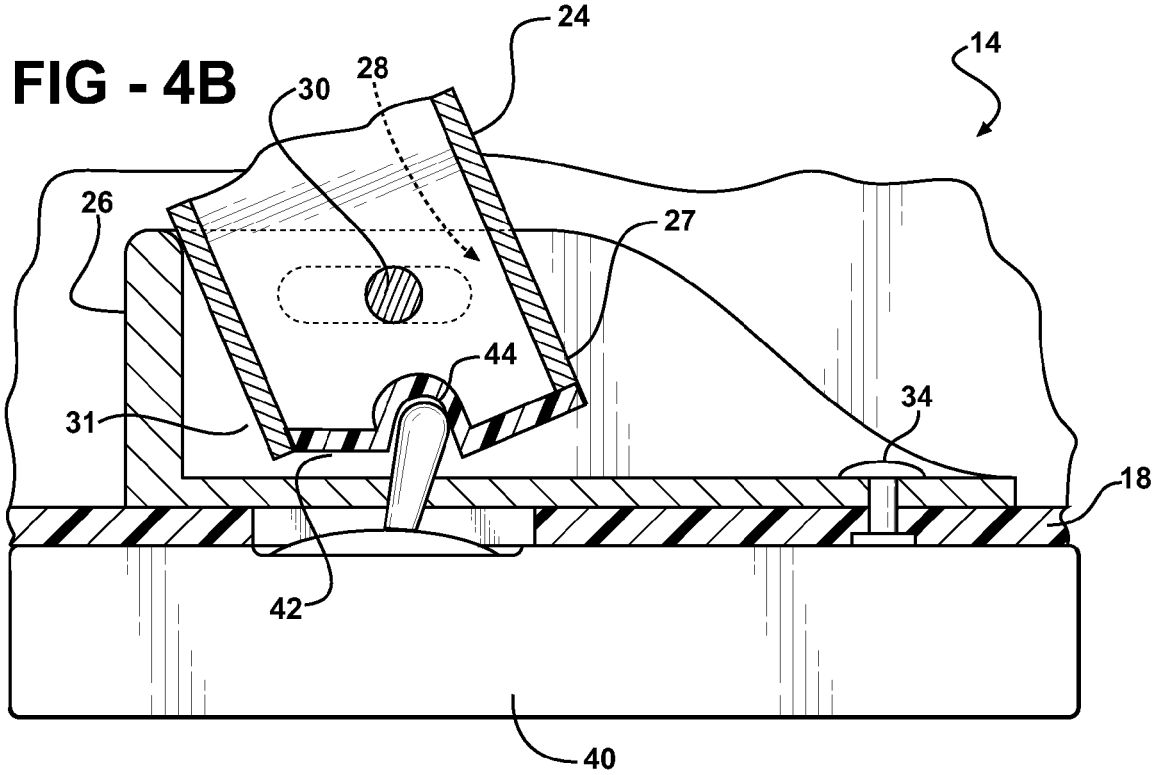
FIG. 4B is a partial cross-sectional view of the main unit showing the sensor block operatively connected to the control stick while the control stick is in another position.

As shown in FIGS. 4A and 4B, in the preferred embodiment, the lower end of the control stick 24 defines a base surface 31 being curvilinear. This curved base surface 31 cooperates with the guide piece 26 to allow free movement of the control stick 24 in the vertical plane.

In the preferred embodiment, the control stick 24 is also movable about an arc in a horizontal plane such that the control stick 24 may swing left or right. Specifically, the guide piece 26 rotates about a second pivot axis 34 to define the arc. Again, this configuration allows the user to move the control stick 24 in the horizontal plane simply by pivoting their hand at the wrist. Furthermore, this configuration allows the user to move the control stick 24 in the horizontal plane while simultaneously moving the control stick 24 in the vertical plane. The second pivot axis 34 may be implemented as a bolt and nut to secure the guide piece 26 to the structural element 18. Of course, those skilled in the art realize other techniques to implement the guide piece rotating about the second pivot axis 34.

Figure 5:
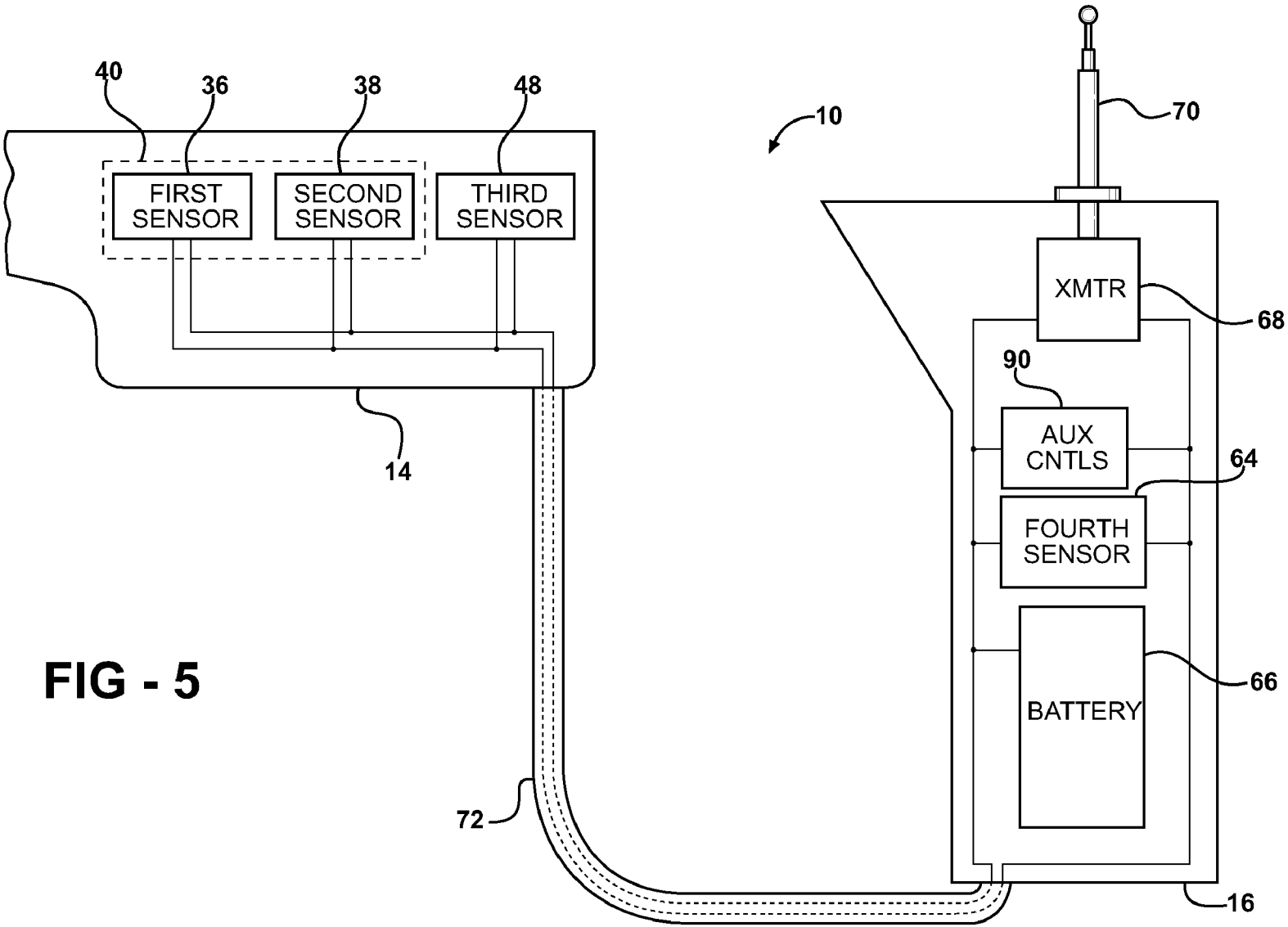
FIG. 5 is an electrical block schematic diagram of a preferred embodiment of the control system showing the main unit electrically connected to an auxiliary unit via a cable.

Referring now to FIG. 5, the control system 10 includes at least one control stick sensor operatively connected to the control stick 24 for sensing movement of the control stick 24. The at least one control stick sensor is preferably mounted to the structural element 18 of the main unit 14 and generates a control stick sensor signal corresponding to the movement of the control stick 24. In the preferred embodiment, the at least one control stick sensor is implemented as a first sensor 36 and a second sensor 38.

The first sensor 36 is operatively connected to the control stick 24 and senses movement of the control stick 24 along a first path. Specifically, in the preferred embodiment, the first path is defined by the movement of the control stick 24 about the vertical plane as described above. As the control stick 24 moves in the vertical plane, the first sensor 36 produces a pitch signal which corresponds to a desired movement of an elevator of the aircraft 12. The second sensor 38 is operatively connected to the control stick 24 and senses movement of the control stick 24 along a second path. The second path is different from the first path. Specifically, in the preferred embodiment, the second path is defined by movement of the control stick 24 about the arc in the horizontal plane. The second sensor 38 produces a roll signal which corresponds to the desired movement of ailerons of the aircraft 12. The first and second sensors 36, 38 may each include a potentiometer (not shown), such that the resistance of each potentiometer changes in response to movement of the control stick 24. Of course, in other embodiments, where the controlled object is not a fixed wing aircraft 12, the "pitch signal" and "roll signal" may correspond to other aspects of the controlled object besides pitch and roll. These aspects include, but are not limited to, wheel direction, propeller direction, etc., as is well known by those skilled in the art.

The first and second sensors 36, 38 may be combined as a single sensor block 40. Referring again to FIGS. 4A and 4B, the sensor block 36 is operatively connected to the control stick 24 via a single lever 42. Specifically, the base surface 31 of the control stick 24 defines a recess 44 to accommodate the lever 42. In this configuration, the sensor block 40 and lever 42 is identical to the traditional "two-channel" sensor and joystick controls found on popular control devices for radio control of aircraft. Therefore, manufacturers of these prior art control devices could integrate existing designs and inventory into the main unit 14 of the control system 10.

Figure 6:
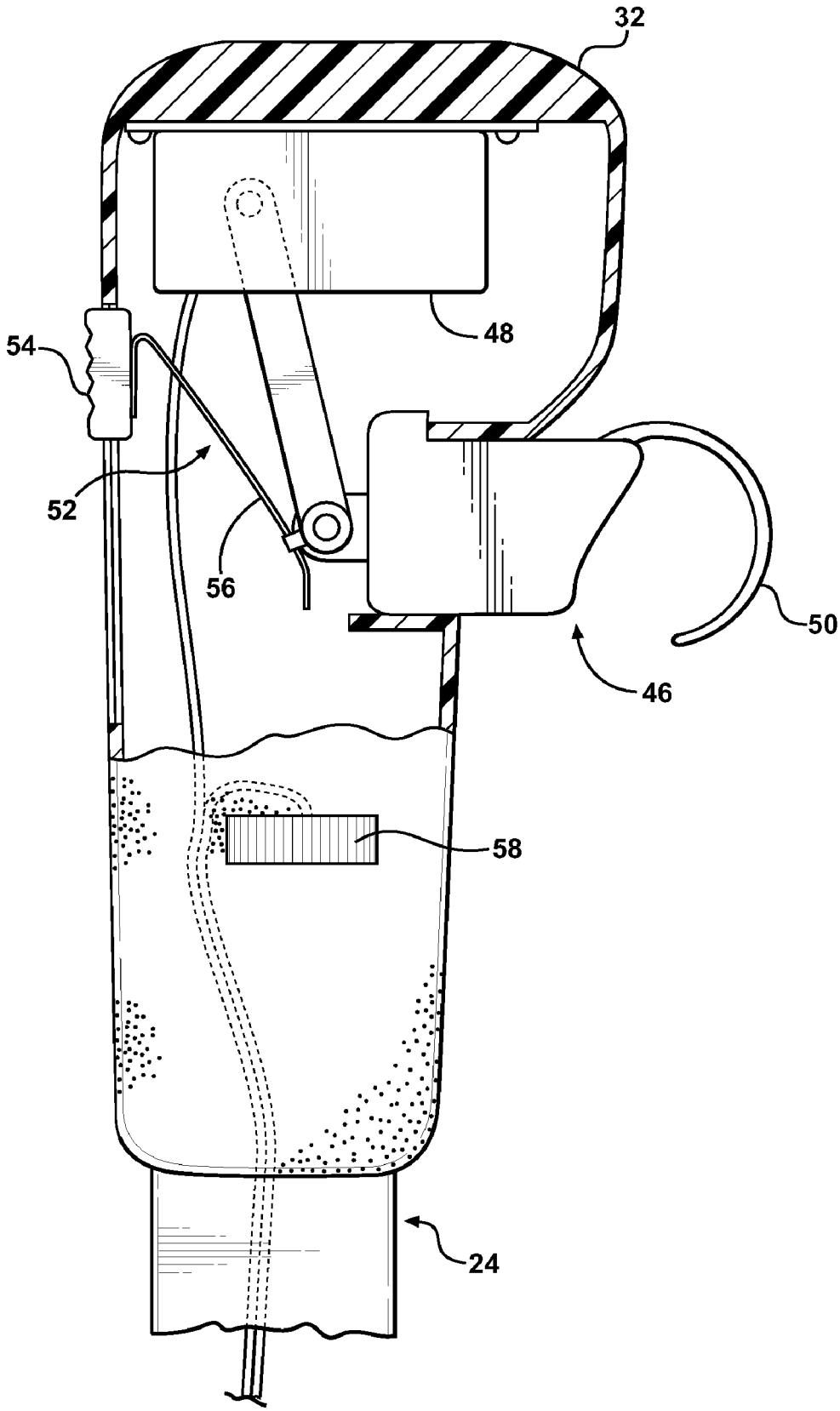
FIG. 6 is partial cross-sectional view of the control stick showing a throttle button with a throttle locking mechanism tensioned by a spring.

Referring now to FIG. 6, the control stick 24 also includes a throttle button 46. A third sensor 48 is operatively connected to the throttle button 46 and senses movement of the throttle button 46. The third sensor 48 produces a throttle signal which corresponds to the position of the throttle button 46 and, accordingly, the desired throttle setting (i.e., speed setting) of the aircraft 12. Preferably, the throttle button 46 is pushed inward to increase the throttle setting of the aircraft and pulled outward to decrease the throttle setting. The throttle button 46 preferably includes a hook 50 for allowing the user to pull the throttle button 46 outward. Of course, those skilled in the art realize that the throttle button 46 may alternatively be used to control the motor speed of an electrically powered aircraft 12.

The control stick 24 includes a throttle locking mechanism 52 for locking the throttle button 46 in place. The throttle locking mechanism 52 allows the user to set a constant throttle speed without having to keep constant pressure on the throttle button 46. The throttle locking mechanism 52 preferably includes a slider 54 connected to a spring 56. The slider 54 may be operated by the thumb of the user. The spring 56 operatively engages with the throttle button 46 when the slider 52 is in an upward position. Of course, those skilled in the art appreciate other techniques for locking the throttle button 46 in place.

The control system 10 may also include one or more trim adjustment controls 58. Each trim adjustment control 58, also commonly referred to as a "trim tab" by those skilled in the art, correspond to one of the sensors. The trim adjustment controls allow adjustment of the corresponding sensors 36, 38, 48 such that a "zero" of the sensor 36, 38, 48 may be established or to otherwise adjust the signal generated by the sensor 36, 38, 48. One example of a trim adjustment control 58, implemented as a wheel or dial control, is shown in FIG. 6 to allow trimming of the third sensor 48.

Figure 7:
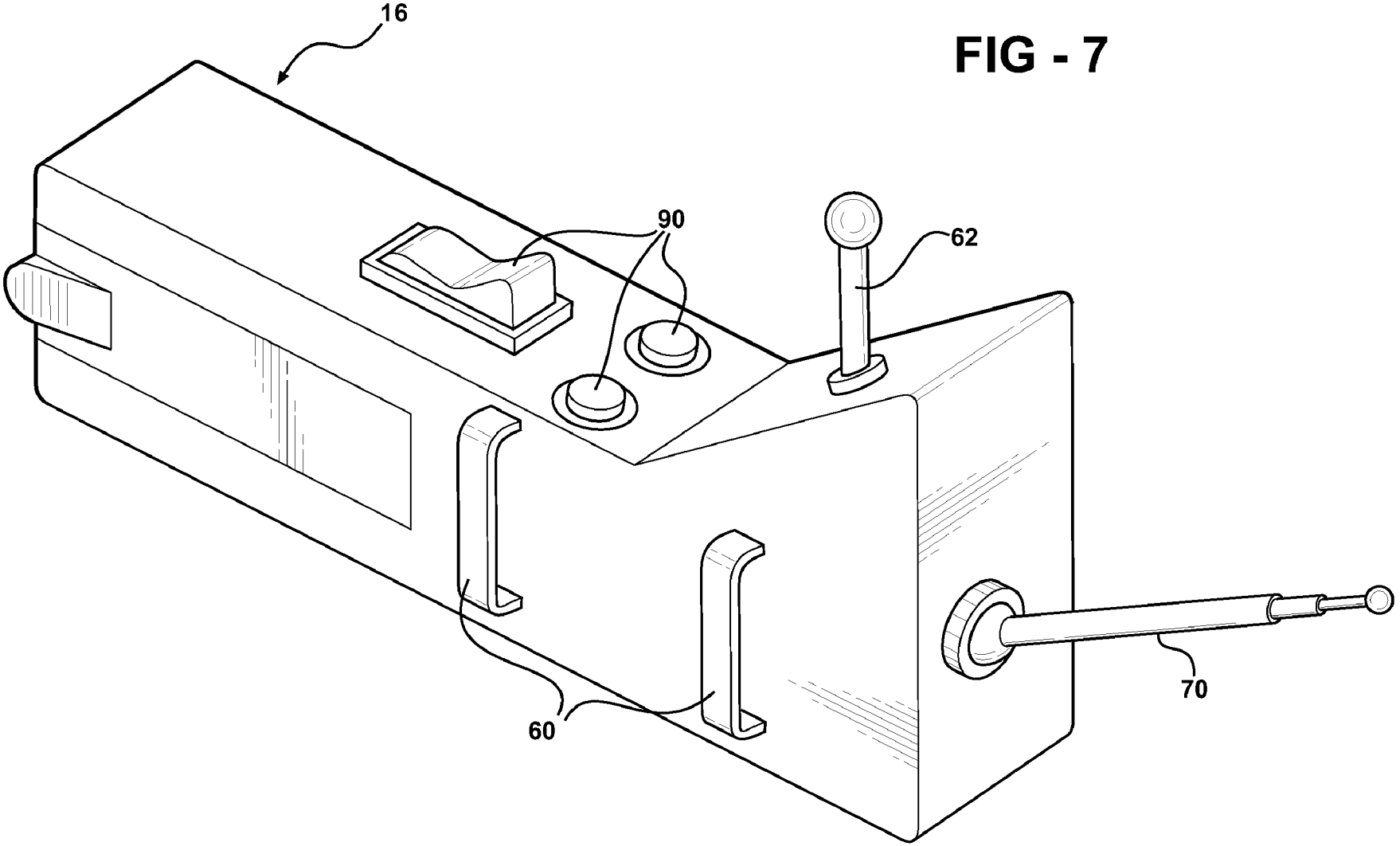
FIG. 7 is a perspective view of the auxiliary unit of the control system.

As stated above, and in reference to FIG. 7, the control system 10 of the preferred embodiment includes an auxiliary unit 16. The auxiliary unit 16 preferably includes at least one belt loop 60 for allowing support of the auxiliary unit 16 on a belt worn by the user. Alternatively, the auxiliary unit 16 may include a clip (not shown) for allowing support on the belt or a waistband of clothing worn by the user. The belt loop(s) 60 or clip may be reversible on the auxiliary unit 16 such that the auxiliary unit 16 may be supported on either left or right sides of the user for left-handed or right-handed operation by the user. Those skilled in the art realize other alternatives for supporting the auxiliary unit 16 on the user.

The auxiliary unit 16 includes a joystick 62 movable along at least one path. A fourth sensor 64, as shown in FIG. 5, is operatively connected the joystick 62 and produces a yaw signal which corresponds to the movement of the joystick and the desired movement of a rudder and/or wheels of the aircraft 12. In typical operation of the control system 10, the control stick 24 of the main unit 14 is operated by one hand of the user while the joystick 62 of the auxiliary unit 16 is operated by the other hand of the user.

Still referring to FIG. 5, in the preferred embodiment, the auxiliary unit 16 further includes a battery 66, a transmitter 68, and an antenna 70. The battery 66 may be implemented as one of the numerous electrical storage devices well known to those skilled in the art. The battery 66 is electrically connected to each sensor 36, 38, 48, 64 to provide electrical power to the sensors 36, 38, 48, 64. As described above, each sensor 36, 38, 48, 64 generates a signal.

The transmitter 68 is in communication with each sensor 36, 38, 48, 64 and receives the signal generated by each sensor 36, 38, 48, 64. The transmitter 68 is electrically connected to the antenna 70 and generates a transmitter signal which is broadcast through the antenna 70 for reception by the aircraft 12. The transmitter signal encodes the signals from each sensor 36, 38, 48, 64 in the transmitter signal such that the aircraft 12 may receive the signals from each sensor 36, 38, 48, 64 and respond accordingly. The transmitter 68 is preferably a radio frequency (RF) transmitter capable of broadcasting the transmitter signal as a modulated, RF waveform, as is well known to those skilled in the art. The transmitter is electrically connected to the battery 66 to receive power from the battery 66.

In the preferred embodiment, each sensor 36, 38, 48, 64 is electrically connected to the transmitter 68 for establishing the communication described above. A cable 72 preferably provides the electrical connection between the main unit 14 and the auxiliary unit 16. As such, the cable 72 carries the electrical power from the battery 66 to the sensors 36, 38, 48 in the main unit 14 and carries the signals from the sensors 36, 38, 48 in the main unit 14 to the transmitter 68 in the auxiliary unit 16.

Figure 8:
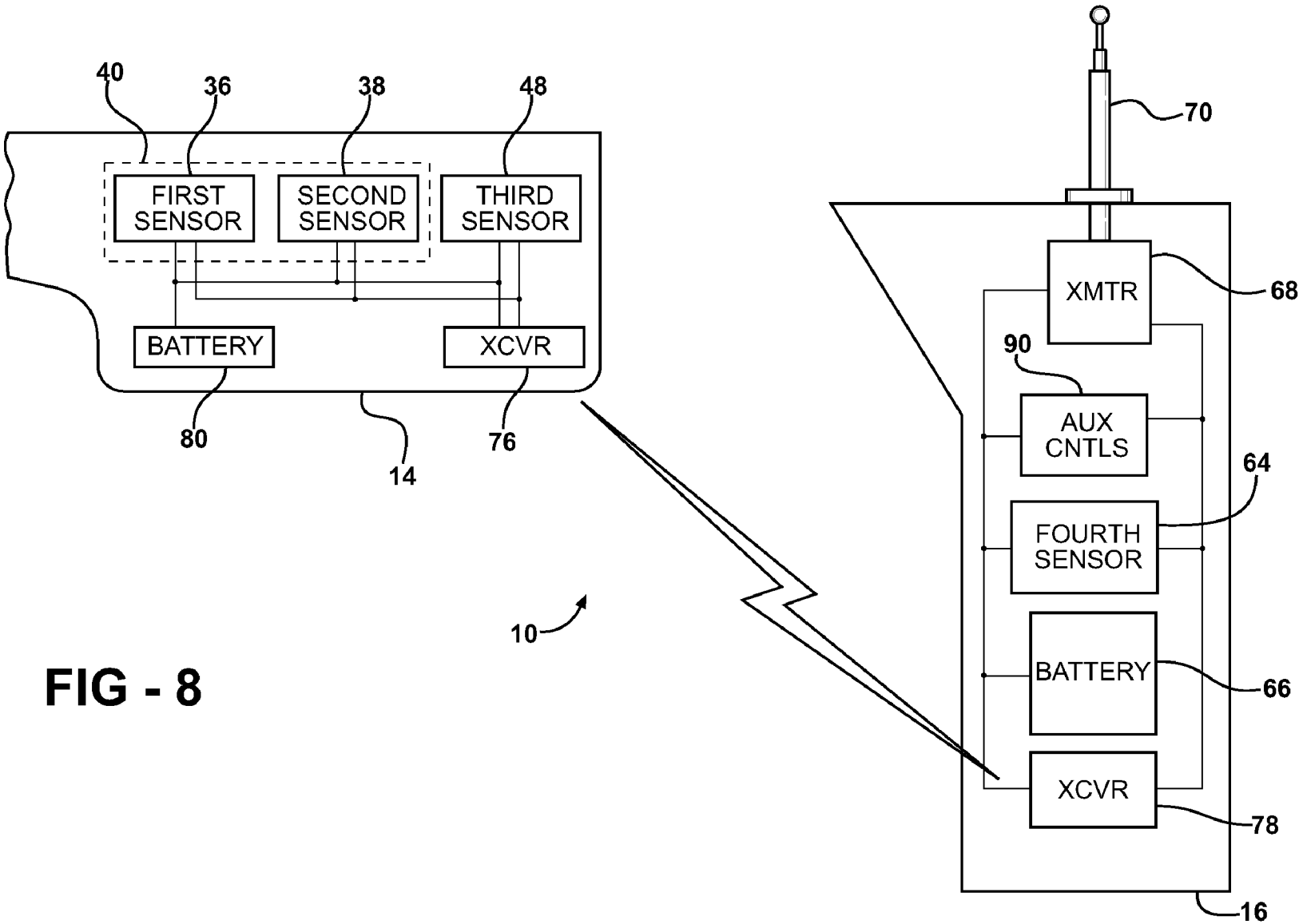
FIG. 8 is an electrical block schematic diagram of an alternative embodiment of the control system showing the main unit in communication with the auxiliary unit via a wireless interface.

Referring now to FIG. 8, in an alternative embodiment, a wireless interface 74 provides the communication between sensors 36, 38, 48 of the main unit 14 and the transmitter 68 disposed in the auxiliary unit 16. The wireless interface 74 includes a main transceiver 76 disposed in the main unit 14 and an auxiliary transceiver 78 disposed in the auxiliary unit 16. The transceivers 76, 78 are preferably low-power RF transceivers utilizing Bluetooth or other suitable wireless standard. Of course, in this alternative embodiment, the main unit 14 includes its own battery 80 for powering the sensors 36, 38, 48 and the main transceiver 76.

Referring again to FIG. 7, the auxiliary unit 16 may also include at least one auxiliary control button 90 and preferably a plurality of auxiliary control buttons 90. These buttons 90 may be used to control aspects of the aircraft 12 or the control system 10 itself. For example, one button 90 may be used to extend and/or retract landing gear (not shown) of the aircraft 12 while another button 90 may be used to turn on/off power to the control system 10. The buttons 90 may be implemented as pushbuttons, switches, or other suitable implementations as are known to those skilled in the art. Furthermore, other applications for the auxiliary control buttons 90 are evident to those skilled in the art. As shown in FIGS. 5 and 8, the auxiliary control buttons 90 may be electrically connected to the battery 66 and the transmitter 68, depending on the function of the specific auxiliary control button 90.

As stated above, by disposing the transmitter 68 in the auxiliary unit 16 separate from the main unit 14, the arm of the operator need not support this weight. Therefore, fatigue and strain to the arm are kept to a minimum, allowing a more comfortable experience which may be sustained for a longer period of time.

The joystick 62 and control buttons 90 of the auxiliary unit may be assigned to control pitch and throttle of the aircraft 12. Those skilled in the art appreciate that traditional helicopter controls feature the pitch and throttle controls on the left hand side of the pilot. Therefore, the control system 10 of the subject invention can provide a more realistic model helicopter flying experience where the main unit 14 is attached to the right arm of the operator while the auxiliary unit 16 is attached to the left side of the operator. Therefore, control of a model helicopter may more closely resemble control of an actual helicopter.

The control system 10 may also be utilized to control an aircraft 12 tethered by a line 84. This form of operation is typically referred to as "line control". Since the availability of traditional line control aircraft is limited, the control device 10 may be utilized to retrofit radio control aircraft 12. A harness (not shown) may be worn by the radio control aircraft 12 and attached to the line 84.

Figure 9:
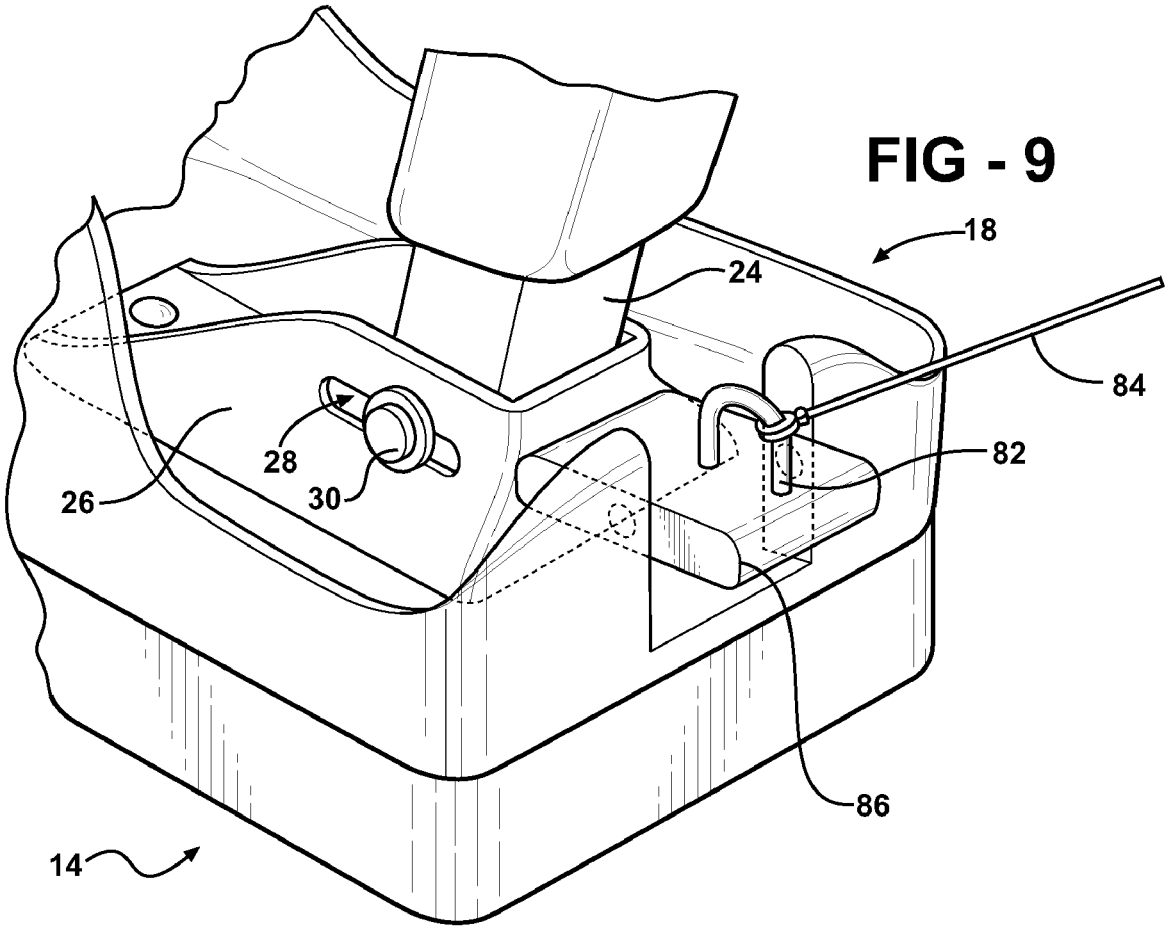
FIG. 9 is partial perspective view of the main unit showing a guide piece locking mechanism and line attachment apparatus for line control of the aircraft.

As shown in FIG. 9, the main unit 14 of the preferred embodiment also includes a line attachment apparatus 82 supported by the structural element 18 for allowing attachment of the line 84 connecting the structural element 18 to the aircraft 12. The main unit 14 may also include a guide piece locking mechanism 86. The guide piece locking mechanism 86 is engagable with the guide piece 26 for locking the guide piece 26 in place and preventing movement of the control stick 14 in the horizontal plane. By preventing movement of the control stick 14 in the horizontal plane, the control system 10 prevents transmission of a roll signal and corresponding aileron movement, which is undesirable when operating an aircraft 12 under line control. However, when the guide piece locking mechanism 86 is engaged with the guide piece 26, the control stick 24 is still movable in the vertical plane. As shown in FIG. 9, the line attachment apparatus 82 may be implemented as a loop and integrated with the guide piece locking mechanism 86. Those skilled in the art will realize other techniques for implementing the line attachment apparatus 82 and guide piece locking mechanism 86.

An aircraft 12 that is tethered by the cable 74 may operate in a much smaller geographical location than that typically required for non-tethered radio controlled aircraft 12. Thus, the line control functionality of the control device 12 provides additional opportunity for aircraft 12 users to practice and enjoy their hobby and utilize radio-controlled aircraft 12 in a line-control environment.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A control system for an aircraft comprising:

a main unit having a structural element;

said structural element including an arm support for attachment to an arm of an operator;

said main unit including a control stick supported by said structural element and movable in a plurality of directions;

said main unit further including at least one control stick sensor operatively connected to said control stick for sensing movement of said control stick and generating a control stick sensor signal corresponding to the movement of said control stick;

an auxiliary unit separate from said main unit;

said auxiliary unit including a transmitter in communication with said at least one sensor for sending a transmitter signal to the aircraft corresponding to the control stick sensor signal for controlling the aircraft wherein said auxiliary unit further includes a joystick.

2. A control system as set forth in claim 1 wherein said auxiliary unit further includes a battery for providing electrical power to said transmitter.

3. A control system as set forth in claim 1 further comprising a cable interconnected between said main unit and said auxiliary unit for providing communication between said at least one sensor and said transmitter.

4. A control system as set forth in claim 1 further comprising a wireless interface for providing communication between said at least one sensor and said transmitter.

5. A control system as set forth in claim 1 wherein said at least one control stick sensor is further defined as a first sensor for sensing movement of said control stick in along a first path and a second sensor for sensing movement of said control stick along a second path different from said first path.

6. A control system as set forth in claim 5 wherein said first sensor generates a pitch signal during movement of said control stick along said first path for moving an elevator of the aircraft.

7. A control system as set forth in claim 5 wherein said second sensor generates a roll signal during movement of said control stick along said second path for moving ailerons of the aircraft.

8. A control system as set forth in claim 1 wherein said main unit further includes a throttle button.

9. A control system as set forth in claim 8 wherein said main unit includes a third sensor operatively connected to said throttle button for sensing movement of said throttle button and generating a throttle signal corresponding to a position of said throttle button.

10. A control system as set forth in claim 1 wherein said auxiliary unit further includes a fourth sensor operatively connected to said joystick for sensing movement of said joystick and generating a yaw signal corresponding to the movement of said joystick.

11. A control system for an aircraft comprising:

a structural element including an arm support for attachment to an arm of an operator;

a guide piece supported by said structural element and defining an elongated slot;

a control stick having an upper end and a lower end;

a pin disposed in said control stick between said upper and lower ends and defining a first pivot axis with said pin slidably disposed in said elongated slot such that said control stick pivots about said pivot axis and simultaneously slides along said elongated slot within a vertical plane;

a sensor mounted to said structural element and operatively connected to said control stick for sensing movement of said control stick and generating a sensor signal corresponding to the movement of said control stick in said vertical plane; and a transmitter in communication with said sensor for sending a transmitter signal to the aircraft corresponding to the sensor signal for control of the aircraft.

12. A control system as set forth in claim 11 wherein said pin is disposed approximate to said lower end of said control stick.

13. A control system as set forth in claim 11 wherein said lower end of said control stick engages said sensor.

14. A control system as set forth in claim 11 wherein said guide piece is rotatable about a second pivot axis such that said control stick is simultaneously movable in a horizontal plane.

15. A control system as set forth in claim 14 wherein said second pivot axis is transverse to said first pivot axis.

16. A control system as set forth in claim 11 wherein said control stick includes a throttle button for controlling the throttle of the aircraft.

17. A control system as set forth in claim 16 wherein said control stick includes a throttle locking mechanism for locking the position of the throttle button and maintaining a constant throttle of the aircraft.

* * * * *